US012270409B2

(12) United States Patent
Ott

(10) Patent No.: US 12,270,409 B2
(45) Date of Patent: Apr. 8, 2025

(54) RADIAL COMPRESSOR AND METHOD FOR OPERATING A RADIAL COMPRESSOR

(71) Applicant: Robert Bosch GmbH, Stuttgart (DE)

(72) Inventor: Tobias Reinhard Ott, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 18/030,331

(22) PCT Filed: Sep. 29, 2021

(86) PCT No.: PCT/EP2021/076795
§ 371 (c)(1),
(2) Date: Apr. 5, 2023

(87) PCT Pub. No.: WO2022/073821
PCT Pub. Date: Apr. 14, 2022

(65) Prior Publication Data

US 2023/0375000 A1 Nov. 23, 2023

(30) Foreign Application Priority Data

Oct. 6, 2020 (DE) ..... 10 2020 212 605.4

(51) Int. Cl.
*F04D 29/28* (2006.01)
*F04D 17/10* (2006.01)
(Continued)

(52) U.S. Cl.
CPC ..... *F04D 29/284* (2013.01); *F04D 17/10* (2013.01); *F04D 29/083* (2013.01); *F04D 29/4206* (2013.01); *F04D 29/584* (2013.01)

(58) Field of Classification Search
CPC ..... F04D 17/10; F04D 29/284–285; F04D 29/288; F04D 29/4206; F04D 29/582–5846; F04D 29/661–662
See application file for complete search history.

(56) References Cited

U.S. PATENT DOCUMENTS 1,999,163 A * 4/1935 Allen ..... F04D 29/06 277/516
3,123,010 A * 3/1964 Witt ..... F04D 29/2266 415/173.1
(Continued)

FOREIGN PATENT DOCUMENTS

DE 968742 C 3/1958
DE 102012022647 A1 * 5/2014 ..... F01D 25/186
(Continued)

OTHER PUBLICATIONS

Translation of International Search Report for Application No. PCT/EP2021/076795 dated Jan. 14, 2022 (2 pages).
(Continued)

*Primary Examiner* — Brian P Wolcott
(74) *Attorney, Agent, or Firm* — Michael Best & Friedrich LLP

(57) ABSTRACT

The invention relates to a radial compressor (1) comprising at least one impeller wheel (3), which is driven rotatably in a compressor housing (2) and has a wheel front side (5) and a wheel rear side (6), the wheel front side (5) being intended to convey a mass flow (13) by means of a number of blades (7), the wheel rear side (6) of the impeller wheel (3) having a blading (8) by means of which a second pressure distribution (12) is generated on the wheel rear side (6) of the impeller wheel (3) during operation of the radial compressor (1), which second pressure distribution counteracts a first pressure distribution (11) on the wheel front side (5) in order to reduce an axial force that is to be braced in the compressor housing (2).
In order to functionally improve the radial compressor (1), in particular in respect of a use as air supply device in a fuel cell system, the compressor housing (2) is designed and is combined with the blading (8) on the wheel rear side (6) of the impeller wheel (3) such that, during operation of the
(Continued)

radial compressor (1), a cooling air mass flow (14) is conveyed by means of the blading (8) on the wheel rear side (6) of the impeller wheel (3) in addition to the mass flow conveyed by means of the blades (7) on the wheel front side (5).

15 Claims, 2 Drawing Sheets

(51) Int. Cl.
*F04D 29/08* (2006.01)
*F04D 29/42* (2006.01)
*F04D 29/58* (2006.01)

(56) References Cited

U.S. PATENT DOCUMENTS 4,378,196 A * 3/1983 Leskinen ..... F01D 3/00 415/106
4,613,281 A * 9/1986 Lubieniecki ..... F16J 15/406 415/176
5,605,434 A * 2/1997 Haag ..... F04D 29/2288 415/106
6,276,896 B1 * 8/2001 Burge ..... F04D 29/284 415/115
7,010,916 B2 * 3/2006 Sumser ..... F01D 25/14 417/406
7,252,474 B2 * 8/2007 Belokon ..... F04D 29/124 415/173.5
11,143,096 B2 * 10/2021 Wengert ..... F04D 29/5826
2016/0032931 A1 * 2/2016 Lee ..... F04D 29/584 417/368
2018/0238339 A1 * 8/2018 Nickson ..... F04D 29/284

FOREIGN PATENT DOCUMENTS

DE 102018215068 A1 3/2020
GB 452019 A * 8/1936
JP 858113599 A 7/1983
JP 2009091935 A 4/2009

OTHER PUBLICATIONS

Translation of Japanese Patent Office Action for Application No. 2023-520070 dated Nov. 13, 2023 (5 pages).

* cited by examiner

RADIAL COMPRESSOR AND METHOD FOR OPERATING A RADIAL COMPRESSOR

BACKGROUND

The invention relates to a radial compressor comprising at least one impeller wheel, which is driven rotatably in a compressor housing and has a wheel front side and a wheel rear side, the wheel front side being intended to convey a mass flow by means of a number of blades, the wheel rear side of the impeller wheel having a blading by means of which a second pressure distribution is generated on the wheel rear side of the impeller wheel during operation of the radial compressor, which second pressure distribution counteracts a first pressure distribution on the wheel front side in order to reduce an axial force that is to be braced in the compressor housing. The invention further relates to a method for operating such a radial compressor.

An impeller wheel for a radial turbo compressor comprising a wheel front side and a wheel rear side is known from the German patent application DE 10 2018 215 068 A1, wherein the wheel front side is provided with a number of blades for conveying a medium, wherein the wheel rear side of the impeller wheel has a number of blades, wherein the blades are configured and arranged on the wheel rear side such that, during operation of the radial turbo compressor, a second pressure distribution is generated by the blades on the wheel rear side of the impeller wheel, which is identical to a first pressure distribution on the wheel front side or deviates by less than ten percent from the first pressure distribution, in order to reduce an axial force to be braced on an axial bearing of the radial turbo compressor.

SUMMARY

The problem addressed by the invention is to functionally improve a radial compressor, in particular with regard to a use as an air supply device in a fuel cell system.

With a radial compressor comprising at least one impeller wheel, which is driven rotatably in a compressor housing and has a wheel front side and a wheel rear side, wherein the wheel front side is intended to convey a mass flow by means of a number of blades, wherein the wheel rear side of the impeller wheel has a blading by means of which a second pressure distribution is generated on the wheel rear side of the impeller wheel during operation of the radial compressor, which second pressure distribution counteracts a first pressure distribution on the wheel front side in order to reduce an axial force that is to be braced in the compressor housing, the underlying problem is solved in that the compressor housing is designed and is combined with the blading on the wheel rear side of the impeller wheel such that, during operation of the radial compressor, a cooling air mass flow is conveyed by means of the blading on the wheel rear side of the impeller wheel in addition to the mass flow conveyed by means of the blades on the wheel front side. For example, the impeller wheel is driven by means of an electric motor in order to compress a medium, in particular air, supplied to the wheel front side. Thus, the compressor is also referred to as an air compressor. In a fuel cell system, air compressed with the air compressor is supplied to a cathode of a fuel cell. The compressor can be drivably connected to a turbine driven by an exhaust gas of the fuel cell, as an alternative or in addition to an electric engine. For example, the impeller wheel is fixed to a shaft that rotates about its axis of rotation during operation of the radial compressor. An axial direction is defined by the axis of rotation. Axial means in the direction or parallel to the axis of rotation of the impeller wheel or shaft. Analog means radially transverse to the axis of rotation of the impeller wheel. For example, two radial bearings and one axial bearing are required in order to bear the impeller wheel with the shaft in the compressor housing. In the German patent application DE 10 2018 215 068 A1 mentioned above, it is described how the axial force to be braced with the axial bearing in the compressor housing can be reduced or equalized by the blading of the impeller wheel on the wheel rear side. This function is also carried out by the blading on the wheel rear side of the impeller wheel to the claimed radial compressor. In addition, the blading on the wheel rear side of the impeller wheel is utilized during operation of the claimed radial compressor in order to convey cooling air. The conveyed cooling air can then advantageously be used directly in the radial compressor itself, for example to cool the radial bearings and the axial bearings. The bearing cooling is particularly advantageous when used in a fuel cell system, because the radial compressor is operated there at extremely high speeds. The bearings for bearing the impeller wheel with the shaft are advantageously arranged as air bearings.

A preferred embodiment of the radial compressor is characterized in that the radial compressor has an intake opening radially within the blading on the rear of the impeller wheel, through which cooling air is drawn for the cooling air mass flow. The intake opening can be simply realized in terms of design by allowing, for example, a defined clearance between the impeller wheel and the shaft and the compressor housing. The mass cooling air flow is first conveyed through the entire machine and is discharged from the wheel rear blading at the end of the path.

A further preferred embodiment of the radial compressor is characterized in that the blading on the wheel rear side of the impeller wheel has a larger outer diameter than the blading on the wheel front side. This allows a larger pressure build-up on the wheel rear side in order to ensure that sufficient cooling air is conveyed. This provides the advantage that further mechanisms for impeller wheel cooling and/or bearing cooling and/or rotor cooling can be omitted.

A further preferred embodiment of the radial compressor is characterized in that the impeller wheel is arranged with the blades on the wheel front side and the blading is arranged on the wheel rear side of the impeller wheel in the compressor housing such that the cooling air mass flow conveyed by means of the blading on the wheel rear side of the impeller wheel is merged with the mass flow conveyed by means of the blades on the wheel front side in the compressor housing. This is particularly advantageous when used as an air compressor in a fuel cell system. The total mass air flow can then be divided almost arbitrarily and used in the fuel cell system. The great majority of the mass flow is compressed on the front side, and a small portion is conveyed via the wheel rear side.

A further preferred embodiment of the radial compressor is characterized in that the radial compressor comprises a separating apparatus separating a fluid space on the wheel front side from a fluid space on the wheel rear side of the impeller wheel. This allows, on the one hand, different media to be conveyed on the wheel front side and the wheel rear side of the impeller wheel, if necessary. Typically, there is air on both sides. In addition, it is particularly advantageously enabled that, during operation of the radial compressor with the blading on the wheel rear side, the cooling air is conveyed only against nearly ambient pressure and not against the high final compression pressure of the blades on the wheel front side. Thus, the conveyable flow of cooling air can be effectively increased.

A further preferred embodiment of the radial compressor is characterized in that the fluid space on the wheel rear side of the impeller wheel is substantially subjected to an ambient pressure on the pressure side. There is a lower pressure on the suction side than on the pressure side. After passing through the blading on the wheel rear side, the cooling air mass flow can then advantageously also be used outside the compressor.

A further preferred embodiment of the radial compressor is characterized in that the separating apparatus comprises a seal. The seal is arranged at a suitable location on the compressor housing. With the seal, a separation between the fluid spaces on the wheel front side and the wheel rear side is easily enabled.

In a method for operating an aforementioned radial compressor, the above-mentioned task is alternatively or additionally solved in that, in addition to the mass flow conveyed by means of the blades on the wheel front side, a cooling air mass flow is conveyed by means of the blading on the wheel rear side of the impeller wheel during operation of the radial compressor, which is used for cooling purposes. Thus, bearings, for example air bearings, in the radial compressor can be particularly effectively supplied with cooling air. This enables operation of the radial compressor, especially at extremely high speeds, as seen in fuel cell systems in the air supply.

A preferred embodiment of the method is characterized in that the cooling air mass flow conveyed by means of the blading on the wheel rear side of the impeller wheel during operation of the radial compressor is sucked in and conveyed independently of the mass flow conveyed by means of the blades on the wheel front side. This in particular provides the advantage that the cooling air does not have to be conveyed against a high pressure. This only applies in the event that a sealing element is used between the wheel front side and wheel rear side.

The invention can also relate to a compressor housing, seal, and/or impeller wheel for a radial compressor described above. The mentioned parts can be procured separately.

The invention also relates, if necessary, to the use of such an impeller wheel in an aforementioned radial compressor for providing additional cooling air mass flow.

The invention also relates, if necessary, to a fuel cell system having a radial compressor described above.

BRIEF DESCRIPTION OF THE DRAWINGS

Further advantages, features, and details of the invention arise from the following description, in which various exemplary embodiments are described in detail with reference to the drawing.

The figures show.

DETAILED DESCRIPTION

Figure 1:
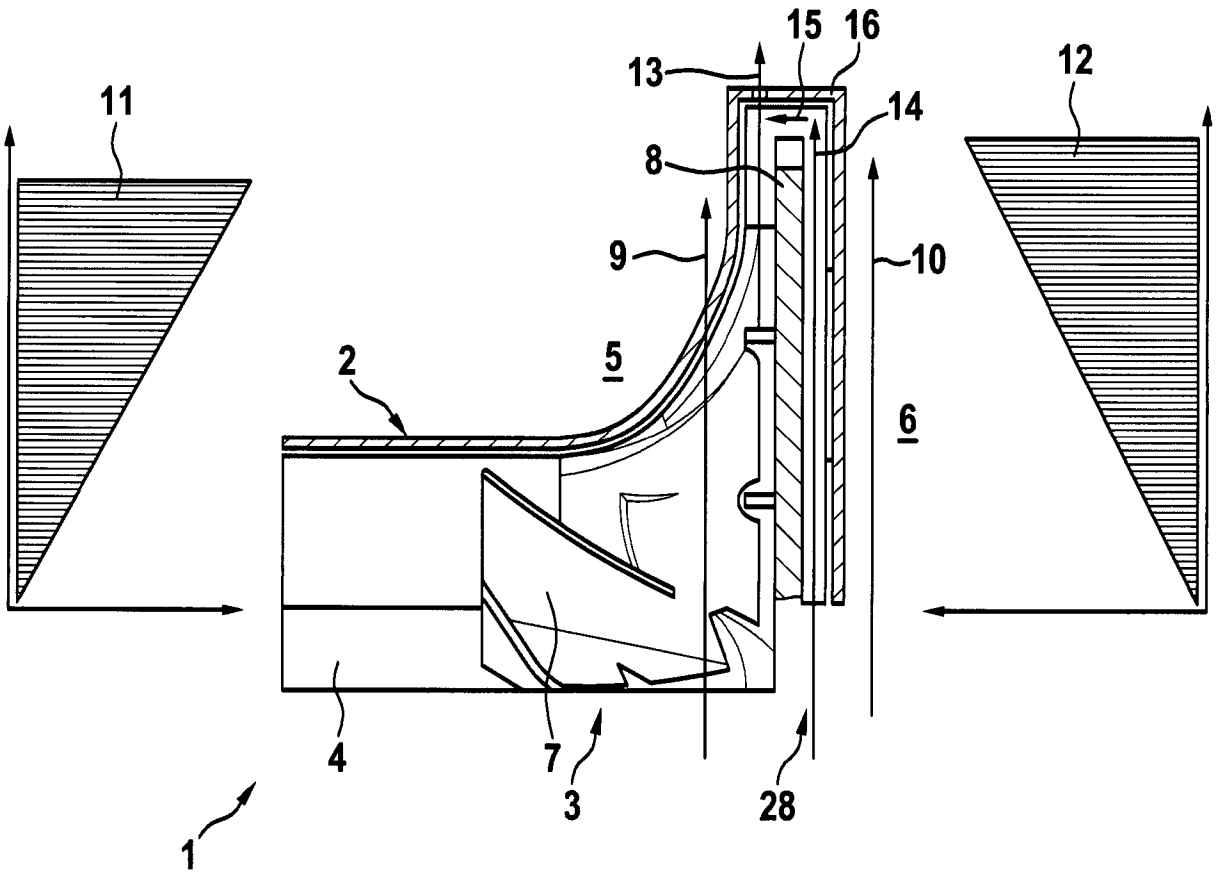
FIG. 1 a schematic representation of a radial compressor having an impeller wheel that has a similar pressure distribution on a wheel front side as on a wheel rear side, wherein the pressure distributions are shown to the left and right of the radial compressor in Cartesian coordinate diagrams according to a first exemplary embodiment.
Figure 2:
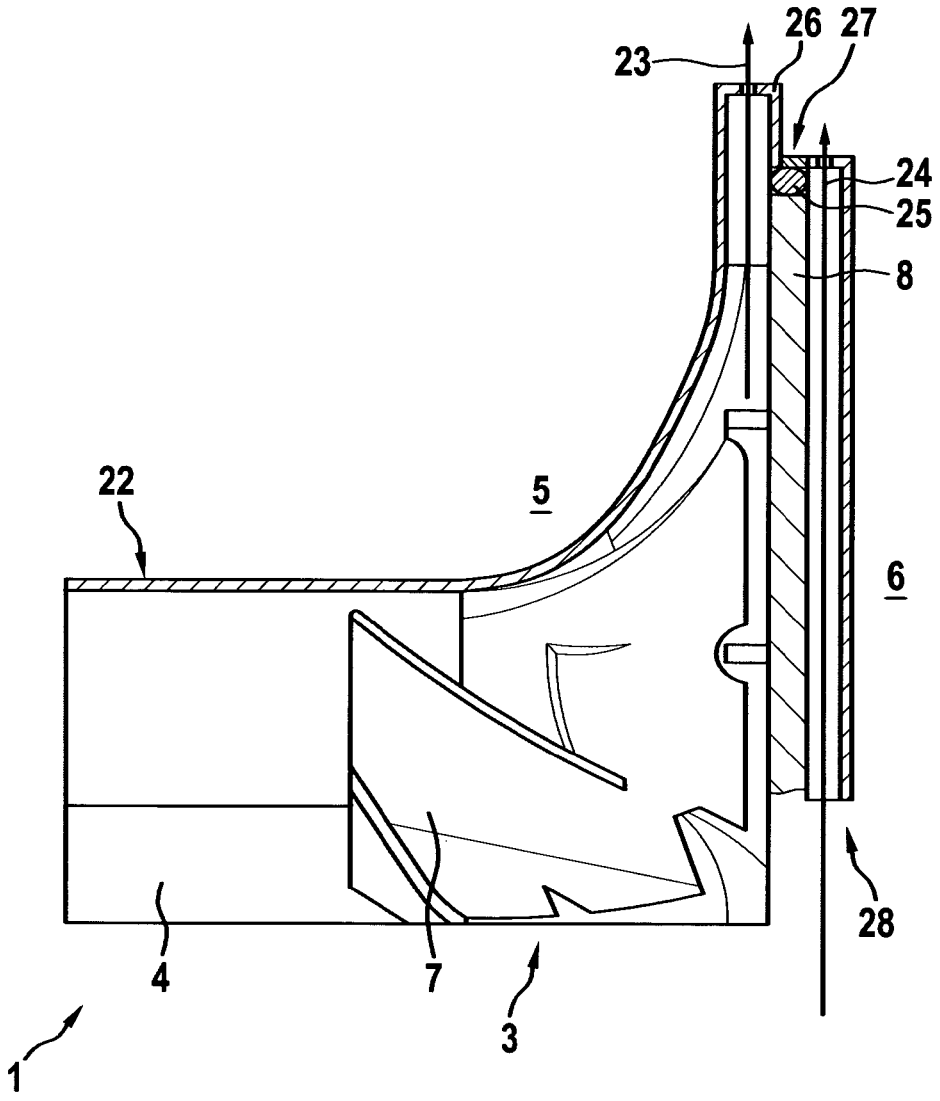
FIG. 2 a similar radial compressor as in FIG. 1 according to a second embodiment without the Cartesian coordinate diagrams, with the pressure distributions.

In FIGS. 1 and 2, two exemplary embodiments of a radial compressor 1 are shown schematically. The compressor 1 comprises a compressor housing 2 in which an impeller wheel 3 is rotatably borne.

The impeller wheel 3 is fixed to a shaft 4, which is indicated in FIGS. 1 and 2 only on the left and is cut off on the right. The impeller wheel 3 is electromotively driven via the shaft 4. A corresponding electric motor for driving the impeller wheel 3 is preferably arranged to the right of the impeller wheel 3 in FIGS. 1 and 2.

For example, the electric motor comprises a rotor that is rotationally fixedly connected to the shaft 4. In addition, a turbine is arranged on the shaft 4, preferably on the right end of the shaft 4 not shown in FIGS. 1 and 2, which serves to drive the impeller wheel 3 of the compressor 1 alternatively or in addition to the electric engine.

The impeller wheel 3 comprises blades 7 on a wheel front side 5, in FIG. 1 on the left. On a wheel rear side 6, in FIG. 1, on the right, the impeller wheel 3 comprises a blading 8. An outer diameter of the blades 7, on the left in FIG. 1, is indicated on the wheel front side 5 by an arrow 9. An outer diameter of the blading 8 of the impeller wheel 3, on the right in FIG. 1, is indicated on the wheel rear side 6 by an arrow 10.

The blades 7 on the wheel front side 5 and the blading 8 on the wheel rear side 6 are designed so that the pressure distributions 11, 12 shown in FIG. 1 on the left and right of the compressor 1 result. The pressure distributions 11 and 12 are each shown in a Cartesian coordinate diagram comprising an x-axis with the pressure and a y-axis with a radius of the impeller wheel 3 in corresponding units.

An arrow 13 in FIG. 1 indicates a mass air flow, which is conveyed radially outwards during operation of the compressor 1 by means of the blades 7 on the wheel front side 5. An arrow 14 indicates a flow of cooling air, which is also conveyed radially outwards by means of the blading 8 on the wheel rear side 6.

By a vertical arrow 15, it is indicated in FIG. 1 that the cooling air mass flow 14 in the compressor housing 2 is merged with the air mass flow 13. The total mass flow then exits the compressor housing 2 through a volute 16 (not shown in further detail).

In FIG. 2, the same reference numerals are used to designate the same or similar parts as in FIG. 1. In the following, only the differences between the two exemplary embodiments are discussed. A compressor housing 22 is combined with a separating apparatus 27 in FIG. 2. The separating apparatus 27 comprises a seal 25 within a volute 26 of the compressor housing 22.

A mass air flow 23 conveyed by means of the blades 7 on the wheel front side 5 is not merged in FIG. 2 with a mass cooling air flow 24 conveyed by means of the blading 8 on the wheel rear side 6 of the impeller wheel 3. The two mass flows 23, 24 independently exit radially outward on the compressor housing 22.

In FIGS. 1 and 2, radially within the blading 8, indicated only by hatching on the wheel rear side 6, an intake opening 28 is indicated, through which cooling air is drawn in for the cooling air mass flow 14, 24.

The invention claimed is:

1. A radial compressor (1) comprising at least one impeller wheel (3), which is driven rotatably in a compressor housing (2) and has a wheel front side (5) and a wheel rear side (6), wherein the wheel front side (5) is configured to convey a mass flow (13, 23) by a number of blades (7), wherein the wheel rear side (6) of the at least one impeller wheel (3) has a blading (8) by which a second pressure distribution (12) is generated on the wheel rear side (6) of the at least one impeller wheel (3) during operation of the radial compressor (1), which second pressure distribution counteracts a first pressure distribution (11) on the wheel front side (5) in order to reduce an axial force that is to be braced in the compressor housing (2), wherein the compressor housing (2) is combined with the blading (8) on the wheel rear side (6) of the at least one impeller wheel (3) such that, during operation of the radial compressor (1), a cooling air mass flow (14, 24) is conveyed by the blading (8) on the wheel rear side (6) of the at least one impeller wheel (3) in addition to the mass flow conveyed by the blades (7) on the wheel front side (5), wherein the radial compressor (1) comprises a separating apparatus (27) completely separating a fluid space containing the mass flow (23) on the wheel front side (5) from a fluid space containing the cooling air mass flow (24) on the wheel rear side (6) of the at least one impeller wheel (3), wherein the mass flow (23) and the cooling air mass flow (24) independently exit radially outward from the compressor housing (2).

2. The radial compressor according to claim 1, wherein the radial compressor (1) comprises an intake opening (28) radially within the blading (8) on the wheel rear side (6) of the at least one impeller wheel (3), through which opening the cooling air mass flow (14, 24), having passed through individual passages of the compressor (1), is conveyed out of the radial compressor.

3. The radial compressor according to claim 1, wherein the cooling air mass flow (24) conveyed by the blading (8) on the wheel rear side (6) of the at least one impeller wheel (3) during operation of the radial compressor (1) is sucked in and conveyed independently of the mass flow (23) conveyed by the blades (7) on the wheel front side (5).

4. A compressor housing (2), seal (25), and/or the at least one impeller wheel (3) for a radial compressor (1) according to claim 1.

5. The radial compressor according to claim 1, wherein the fluid space on the wheel rear side (6) of the at least one impeller wheel (3) is subjected to an ambient pressure.

6. The radial compressor according to claim 1, wherein the blading (8) on the wheel rear side (6) of the at least one impeller wheel (3) has a larger outer diameter (10) than the blades (7) on the wheel front side (5).

7. The radial compressor according to claim 1, wherein the separating apparatus (27) comprises a seal (25).

8. The radial compressor (1) according to claim 1, wherein, in addition to the mass flow (13) conveyed by the blades (7) on the wheel front side (5), the cooling air mass flow (14) is conveyed by the blading (8) on the wheel rear side (6) of the at least one impeller wheel (3) during operation of the radial compressor (1), which is used for cooling purposes (1).

9. A radial compressor (1) comprising at least one impeller wheel (3), which is driven rotatably in a compressor housing (2) and has a wheel front side (5) and a wheel rear side (6), wherein the wheel front side (5) is configured to convey a mass flow (13, 23) by a number of blades (7), wherein the wheel rear side (6) of the at least one impeller wheel (3) has a blading (8) by which a second pressure distribution (12) is generated on the wheel rear side (6) of the at least one impeller wheel (3) during operation of the radial compressor (1), which second pressure distribution counteracts a first pressure distribution (11) on the wheel front side (5) in order to reduce an axial force that is to be braced in the compressor housing (2), wherein the compressor housing (2) is combined with the blading (8) on the wheel rear side (6) of the at least one impeller wheel (3) such that, during operation of the radial compressor (1), a cooling air mass flow (14, 24) is conveyed by the blading (8) on the wheel rear side (6) of the at least one impeller wheel (3) in addition to the mass flow conveyed by the blades (7) on the wheel front side (5), wherein the radial compressor (1) comprises a separating apparatus (27) completely separating a fluid space containing the mass flow (23) on the wheel front side (5) from a fluid space containing the cooling air mass flow (24) on the wheel rear side (6) of the at least one impeller wheel (3), wherein the blading (8) on the wheel rear side (6) of the at least one impeller wheel (3) has a larger outer diameter (10) than the blades (7) on the wheel front side (5).

10. The radial compressor according to claim 9, wherein the radial compressor (1) comprises an intake opening (28) radially within the blading (8) on the wheel rear side (6) of the at least one impeller wheel (3), through which opening the cooling air mass flow (14, 24), having passed through individual passages of the compressor (1), is conveyed out of the radial compressor.

11. The radial compressor according to claim 9, wherein the cooling air mass flow (24) conveyed by the blading (8) on the wheel rear side (6) of the at least one impeller wheel (3) during operation of the radial compressor (1) is sucked in and conveyed independently of the mass flow (23) conveyed by the blades (7) on the wheel front side (5).

12. A compressor housing (2), seal (25), and/or the at least one impeller wheel (3) for a radial compressor (1) according to claim 9.

13. The radial compressor according to claim 9, wherein the fluid space on the wheel rear side (6) of the at least one impeller wheel (3) is subjected to an ambient pressure.

14. The radial compressor according to claim 9, wherein the separating apparatus (27) comprises a seal (25).

15. The radial compressor (1) according to claim 9, wherein, in addition to the mass flow (13) conveyed by the blades (7) on the wheel front side (5), the cooling air mass flow (14) is conveyed by the blading (8) on the wheel rear side (6) of the at least one impeller wheel (3) during operation of the radial compressor (1), which is used for cooling purposes (1).

* * * * *